US011383118B1

(12) United States Patent
James

(10) Patent No.: US 11,383,118 B1
(45) Date of Patent: Jul. 12, 2022

(54) INFLATABLE IMPACT ATTENUATION DEVICE WITH DISCRETE ELEMENTS

(71) Applicant: Bryan Hines James, Mississauga (CA)

(72) Inventor: Bryan Hines James, Mississauga (CA)

( * ) Notice: Subject to any disclaimer, the term of this patent is extended or adjusted under 35 U.S.C. 154(b) by 287 days.

(21) Appl. No.: 16/865,336

(22) Filed: May 2, 2020

Related U.S. Application Data

(60) Provisional application No. 62/841,894, filed on May 2, 2019.

(51) Int. Cl.
*A63B 6/02* (2006.01)

(52) U.S. Cl.
CPC ..... *A63B 6/02* (2013.01); *A63B 2225/62* (2013.01); *A63B 2243/0025* (2013.01)

(58) Field of Classification Search
CPC ..... A63B 6/02; A63B 2225/62; A63B 2243/0025; A47C 27/00; A47C 27/08
See application file for complete search history.

(56) References Cited

U.S. PATENT DOCUMENTS 3,391,414 A * 7/1968 Gordon ..... A47B 27/08 182/139
3,399,407 A * 9/1968 Olsen ..... A63B 6/02 182/139
4,982,466 A * 1/1991 Higgins ..... A47C 27/082 5/713
4,986,738 A * 1/1991 Kawasaki ..... G05D 16/0404 137/505.11
5,163,196 A * 11/1992 Graebe ..... A61G 5/1043 5/944
5,193,237 A * 3/1993 Holdredge ..... A61G 5/1043 297/DIG. 8
5,329,656 A * 7/1994 Leggett ..... A47C 27/18 5/709
5,452,487 A * 9/1995 Leggett ..... A47C 27/084 5/709
5,815,864 A * 10/1998 Sloop ..... A61G 7/05769 5/713
6,223,673 B1 * 5/2001 Mears ..... B63B 34/52 482/29
7,069,610 B1 * 7/2006 Chai ..... G01G 19/445 177/144
7,409,735 B2 * 8/2008 Kramer ..... A61G 7/015 5/709
7,438,696 B2 * 10/2008 Koonar ..... A61H 9/0078 601/49

(Continued)

*Primary Examiner* — Garrett K Atkinson
(74) *Attorney, Agent, or Firm* — Clinton J. Cusick, Esq.; Cusick IP, PLLC

(57) ABSTRACT

A device for receiving a user and cushioning an impact where a plurality of air displacement units are connected through air displacement units comprising discrete pillars extending above base cells where base cells are selectively connected to adjoining base cells to attenuate and manage air flow. A tarp connected to each base cell provides positional stability and a cover connected across a top surface of the device provides a working surface to receive a user. The combined elements provide a cushioned impact for a user. The device can be inflated with a portable blower positioned within the device that can be battery powered to provide a mobile and portable inflatable impact device.

11 Claims, 10 Drawing Sheets

(56) References Cited

U.S. PATENT DOCUMENTS 7,469,436 B2 * 12/2008 Meyer ..... A61G 7/05784 5/736
8,397,326 B2 * 3/2013 Lafleche ..... A61G 7/05776 5/713
8,460,161 B2 * 6/2013 Cole ..... A63B 21/4035 482/52
8,533,879 B1 * 9/2013 Taylor ..... A47C 27/083 5/613
8,555,441 B2 * 10/2013 Fraser ..... A61G 7/05776 5/713
8,598,893 B2 * 12/2013 Camus ..... G01L 1/142 324/661
8,632,440 B2 * 1/2014 Pratson ..... A63B 21/4035 273/458
8,875,331 B2 * 11/2014 Taylor ..... A61B 5/1126 5/613
8,911,387 B2 * 12/2014 Lafleche ..... A61G 7/05761 601/149
9,591,995 B2 * 3/2017 Blumberg ..... A47C 17/62
9,782,312 B2 * 10/2017 Brubaker ..... A61G 7/05792
9,820,904 B2 * 11/2017 Lafleche ..... A61G 7/05715
10,045,647 B2 * 8/2018 Publicover ..... A63B 21/023
10,463,526 B1 * 11/2019 Zur ..... A61H 9/0078
10,987,265 B2 * 4/2021 Lafleche ..... A61G 7/05761
2004/0023766 A1 * 2/2004 Slone ..... A63B 26/003 482/146
2004/0226102 A1 * 11/2004 Hampton ..... A61G 5/1043 5/713
2006/0010607 A1 * 1/2006 Schneider ..... F16K 31/002 5/713
2006/0085919 A1 * 4/2006 Kramer ..... A61G 7/05776 5/713
2006/0112489 A1 * 6/2006 Bobey ..... A61G 7/05715 5/713
2011/0252570 A1 * 10/2011 Fraser ..... A61G 7/05776 5/713
2014/0026327 A1 * 1/2014 Taylor ..... A61B 5/6887 5/713
2017/0136372 A1 * 5/2017 Koide ..... A63G 31/007
2017/0172331 A1 * 6/2017 Publicover ..... B32B 7/022
2018/0360250 A1 * 12/2018 Publicover ..... A63B 23/10
2021/0227991 A1 * 7/2021 Frank ..... A47C 27/083

* cited by examiner

INFLATABLE IMPACT ATTENUATION DEVICE WITH DISCRETE ELEMENTS

BACKGROUND OF THE INVENTION

Field of the Invention

The present general inventive concept is directed to a structure for receiving a user and cushioning an impact. The structure is useful in training and athletics where a user practices repeated maneuvers that normally involve falling to the ground.

Description of the Related Art

Impact cushions are known in the field of gymnastics and stunt performances. Inflatable devices are known such as bounce houses. Both of these kinds of devices are both bulky and heavy and are not suitable for transport or easy set up. One particular sport where impact cushions are needed but are generally not available is soccer. In particular, a goalie will practice a save directed towards the edge of the goal or the top corner of the goal. In order to practice this technique, the goalie must jump, dive, and extend their arms to the maximum extent possible. This falling or diving usually ends with impacting the ground, often in an outstretched or exposed configuration. Injury to the shoulders or hips can occur, and even if injury is avoided, bruising and irritation can be encountered through repeated iterations of the technique. Injury and soreness can cut the practice short. Additionally, the fear of injury or soreness can discourage the athlete from full extension or full height.

Another technique in soccer is the bicycle kick. This kick involves the athlete falling backwards while extending at least one leg upward to kick a ball at a high point relative to other players. The success of the move requires height and extension, and practicing the move involves the risk of falling on one's head, neck, or shoulders. Again the risk of injury is present, but also the more routine effect of bruising or irritation from repeated practice of the technique and impacts with the ground. Soccer can be played on natural or artificial turf, and neither is cushioned or forgiving. Often practice involves a single or small number of people at an indoor or outdoor field or pitch and the ability to bring a large cushion or matt is limited by a person's carrying capacity or what will fit in a vehicle. Conventional mats or cushions are not suitable.

What is needed is an impact cushion that can be transported and deployed by a single person to facilitate an athletic practice. What is further needed is an inflatable impact cushion that can be stored in a small volume to fit in a car or storage container and easily moved to a desired location and then set up through inflation to achieve a larger more useful size for use. Additionally, what is needed is a portable power supply and an efficient structure design to utilize an efficient amount of power to inflate the impact cushion and maintain the inflation over a useful period of time.

SUMMARY OF THE INVENTION

It is an aspect of the present invention to provide an inflatable impact attenuation device comprising a plurality of air displacement units wherein each air displacement unit comprises a base cell, a pillar connected to said base cell, said pillar extending upward from said base cell, a membrane connected to said base cell and positioned between said base cell and said pillar and at least partially interfering with air flow between said base cell and said pillar, and an air transport opening configured to provide fluid communication with an adjacent base cell.

A further aspect of the invention provides an inflatable impact attenuation device comprising a first row of air displacement units comprising a first air displacement unit, a second air displacement unit, and a third air displacement unit, a second row of air displacement units comprising a fourth air displacement unit, a fifth air displacement unit, and a sixth air displacement unit, a third row of air displacement units comprising a seventh air displacement unit, an eighth air displacement unit, and a ninth air displacement unit, where said first air displacement unit comprises a first base cell and a first pillar positioned above said first base cell and a first membrane positioned between said first base cell and said first pillar; said second air displacement unit comprises a second base cell and a second pillar positioned above said second base cell and a second membrane positioned between said second base cell and said second pillar; said third air displacement unit comprises a third base cell and a third pillar positioned above said third base cell and a third membrane positioned between said third base cell and said third pillar; said first base cell is connected to said second base cell to form a first transverse air transport; and said second base cell is connect to a said third base cell to form a second transverse air transport.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
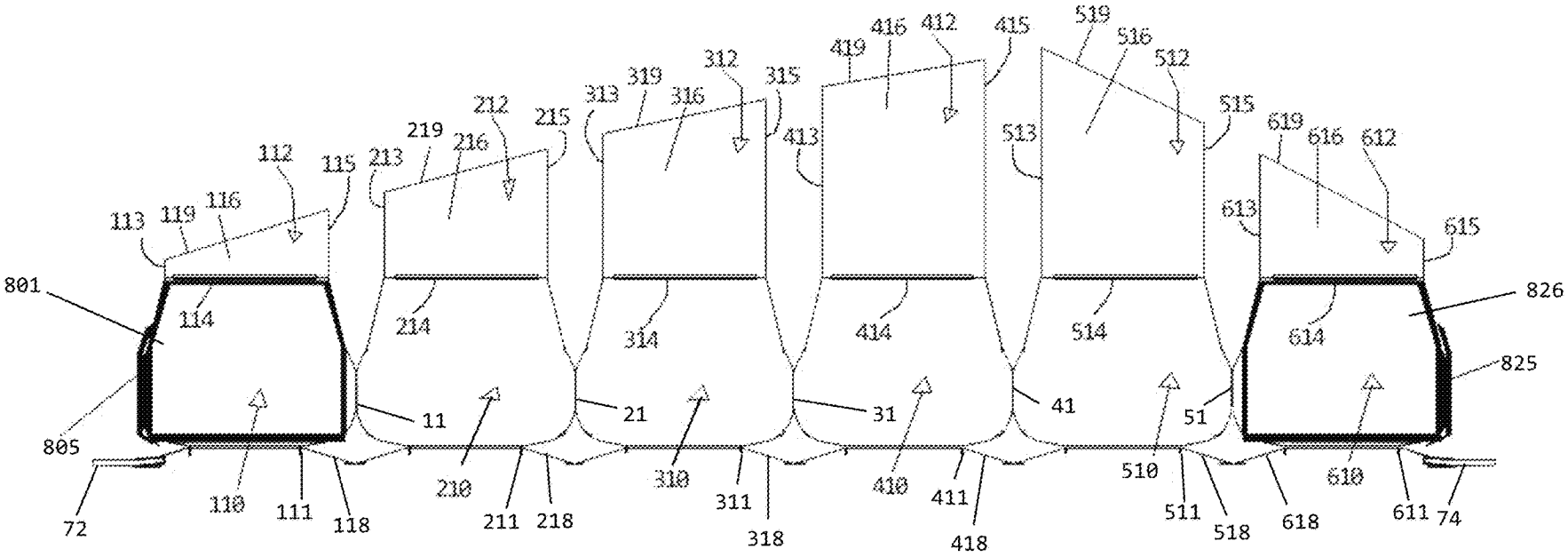
FIG. 1 is a side view of an inflatable impact attenuation device in an embodiment of the invention.

Reference will now be made in detail to the presently preferred embodiments of the invention, examples of which are illustrated in the accompanying drawings, wherein like reference numerals refer to like elements throughout.

The present inventive concept relates to an inflatable impact device suited to receive a user and cushion the impact to allow for repeated iterations of impact while mitigating strain or injury to the user. The device of the invention utilizes a plurality of air displacement units configured to operate independently at absorbing an impact and to work collectively to channel airflow upon impact. The device is efficient in absorbing impact by providing a two tier impact system as well as distributing air throughout the device rather than venting air as in conventional devices. The device is suited for operation in a portable embodiment that uses battery power. Whereas many inflatables retain effectiveness by being connected to a high powered blower to maintain air pressure and bounciness, the present invention is configured to give or yield to receive a user into the device to provide cushion rather than bounce. The configuration of the various air displacement units presents a low vertical threshold at the perimeter of the device while presenting a higher vertical height to receive a user at a higher point during extended leaps or maneuvers.

FIG. 1 presents a side view of an inflatable impact attenuation device in an embodiment of the invention. An air displacement unit is shown comprising a base cell 110 and pillar 112. A second displacement unit is shown comprising a base cell 210 and a pillar 212. A third air displacement unit is shown comprising base cell 310 and pillar 312. Pillar 312 is shown at a height higher than pillar 212 which is in turn higher than pillar 112. The pillars combine to present a working surface that is inclined and suited to receive a falling user. Additional base cells are shown numbered 410, 510, and 610. The base cells can be constructed with a flat bottom, not numbered, and side walls, not numbered that are tapered towards the top so that each base cell is spaced apart from adjacent base cells where it is connected to a pillar. Base cells can be constructed similarly to each other of known materials for inflatables and sewn together as is known in the art. The base cells of the invention are shown in the various figures and comprise a tapered configuration so that when placed adjacent other base cells, the lower portions may be connected to adjacent base cells to assist with inflation and air transport. In an embodiment of the invention, each base cell is connected in fluid communication with at least one other base cell so that the entire device can be inflated by a blower inserted into the device at a single location or base cell. Base cells can be connected to at least one adjacent base cell by way of an air transport opening. An air transport opening can be constructed by stitching a base cell to an adjacent base cell (e.g. round, square, or oval path), and then cutting the fabric interior to the stitching. An air transport opening can also be created by creating an opening in a pair of adjacent base cells, and then sewing or connecting the circumference of the opening to join the base cells around the circumference of the air transport opening. Additional methods can be employed as known in the art including glue, melt adhesive, etc. Air transport openings can be used to allow distribution of air during inflation to reach all regions of the device, but the air transport openings also allow for muted or dampened air flow out of an air displacement unit upon impact. A suitable range for the cross sectional area of an air transport opening about 10 to 30 square inches. In an embodiment of the invention where the base cell can have a volume of 1 cubic foot to 12 cubic feet, an air transport opening can be sized at approximately 18 square inches. A pillar can have a volume of 0.1 cubic feet in a shorter pillar with each dimension less than a foot in length, up to a lager embodiment with a taller pillar having length, width, and height all more than one foot in length and having a volume of up to five cubic feet. The smaller opening compared to the volume of a base cell and volume of a pillar creates a flow restriction. The combination of air flow into adjacent air displacement units allows the air to move, but movement through successive air transport openings dampens the flow rate through successive flow restrictions. Show in FIG. 1, air transport opening 11 connects base cell 110 with base cell 210; air transport opening 21 connects base cell 210 with base cell 310; air transport opening 31 connects base cell 310 with base cell 410; air transport opening 41 connects base cell 410 with base cell 510; and air transport opening 51 connects base cell 510 with base cell 610.

Each pillar can be attached to a base cell. The base cells are configured to be adjoining or close to each other. As the top of the base cell is smaller than the bottom the base cell tops will be spaced apart. Each pillar is configured to match the base cell top and has a cross sectional area and shape to match the base cell top. In an embodiment, the base cell tops are approximately 18 inches by 9 inches to provide a cross sectional area of 162 square inches. The pillars of the device are constructed with a corresponding size and shape where connected to the base cells. It will be understood that the device of the invention can be scaled up or down to provide a larger or smaller working surface or height for various activities. Youth sports would require a lower height, for example.

Figure 2:
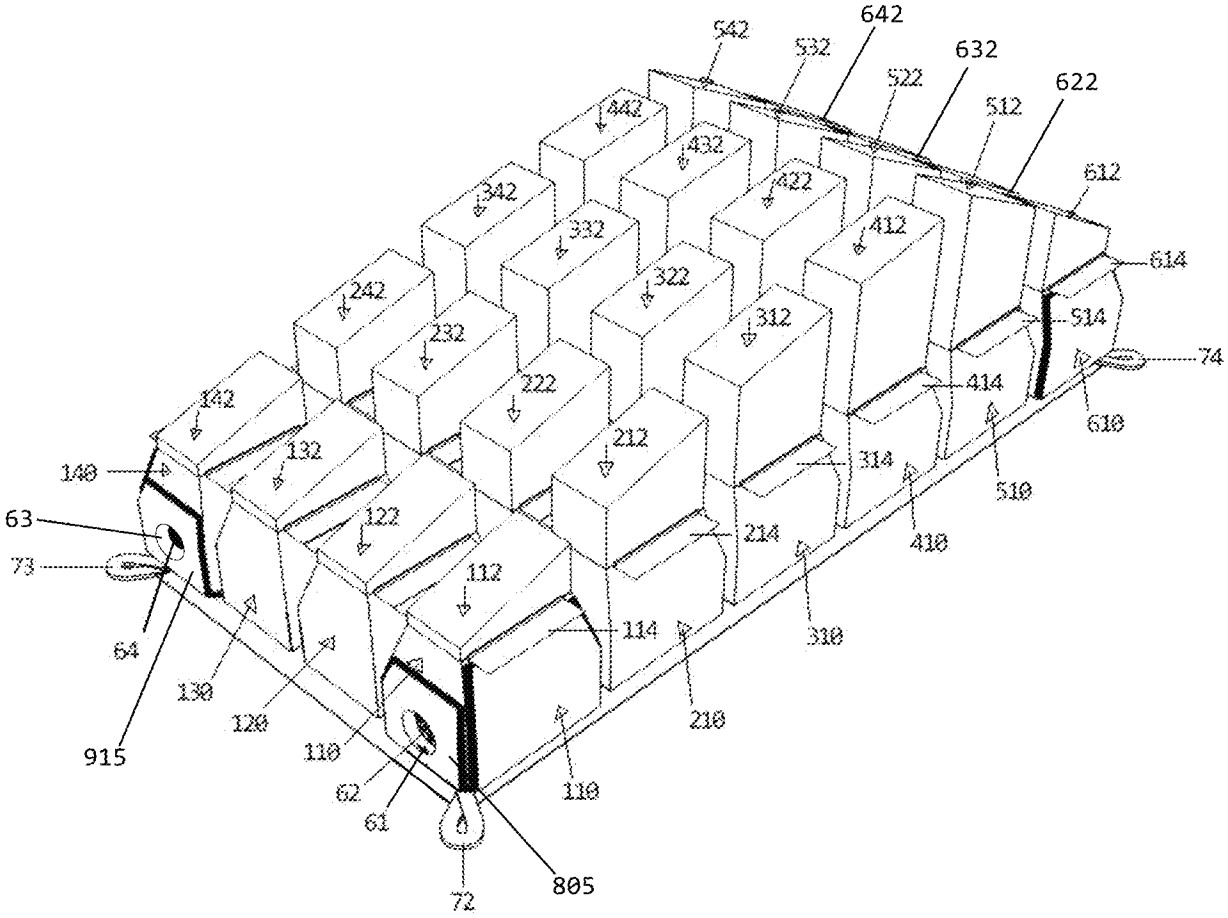
FIG. 2 is a perspective view of an inflatable impact attenuation device in an embodiment of the invention.

Each pillar is preferably constructed of a relatively lightweight material such as nylon or other synthetic materials. In an embodiment 210 Denier urethane coated nylon fabric can be used to construct a lightweight pillar structure that is suited to give or yield upon impact. In order to prevent the pillar fabric traveling into a base cell, a membrane such as membrane 114 can traverse a portion of the boundary between pillar 112 and base cell 110. In similar fashion membrane 214 can be stitched across the top of base cell 210 and membrane 314 can be connected across the top of base cell 310. Membrane 414, 514, and 614 are also shown in FIG. 1. In an embodiment, each air displacement unit comprises a membrane connected across a top of a base cell and a pillar attached to the top each base cell. Each pillar comprises a pillar front wall such as pillar front wall 113. Each pillar also comprises a pillar rear wall such as pillar rear wall 115. Where the front wall and rear wall comprise different heights, pillar top surface 119 will be angled relative the ground. The pillars can be constructed with different front and rear wall heights to create different angles. Different pillars can be constructed with different wall heights relative to other pillars to create a set of pillars aligned with increasing heights to create a smooth incline, or reduced heights to create a decline as seen from left to right in FIG. 1. In particular, pillar front wall 213 is lower than pillar rear wall 215 in pillar 212 to create a slope of pillar top surface 219. Pillar front wall 313 is shorter than pillar rear wall 315 to create the angle of pillar top surface 319. Pillar front wall 413 is shorter than pillar rear wall 415 to create angled pillar top surface 419. Pillar 512 is constructed to create a declining angle where pillar front wall 513 is higher than pillar rear wall 515 to create surface 519 angled towards the rear of the device. Pillar 612 is shown with pillar front wall 613 taller than pillar rear wall 615 and enabling the rearward incline of pillar top surface 619. Shown in this view pillar 112 comprises pillar first side wall 116, and other pillars are similar constructed with a pillar side wall numbered elements 216, 316, 416, 516, and 616 configured to extend from each corresponding base cell of the air displacement unit to a pillar top surface and angled to extend from a pillar front wall to a pillar rear wall. As shown in FIG. 2, each pillar comprises a first side wall in addition to a second side wall, however not all side walls are numbered for clarity. Where each pillar is configured with a light deformable fabric to cushion a user, each membrane is preferably constructed of a material that is heavier and stronger than the pillar fabric, and can be chosen from a group of woven materials such as polyester and nylon athletic mesh. One suitable membrane fabric is polyester athletic mesh with stretch ratio range from 10% to 80%. Each membrane is configured to prevent significant penetration of a user, or part of a user such as a hand or foot, past the membrane and into a base cell. In this way, the pillars of the device are configured to significantly yield while each membrane and base unit is designed to resist and prevent further movement downward and prevent the user from impacting the ground or surface under the device. A blower can be placed inside a base cell to inflate the device of the invention. Blower intake cover 805 can be removed to allow placement of a pump or blower interior to the device. In an embodiment of the invention, removal of the intake cover exposes an opening of approximately 15 inches by 15 inches to allow for placement of the blower into a base cell, for example base cell 110. Blower intake cover 915 can be positioned at a different corner of the device, for example in base cell 140. A removable blower intake cover can be provided in each corner of the device, for example via blower intake cover 825, so that the blower can be placed away from the most likely impact of the user, and avoiding contact between the user and the blower. An alternative cover piece, not shown, can be used to seal the device configured the same as blower intake cover 805, but without intake opening 61. Additionally, placement of the blower interior to the device prevents tripping over or contacting the blower while performing activities near the device. The blower can be battery powered to provide portability of the device where it can be deployed without access to electrical power.

Figure 4:
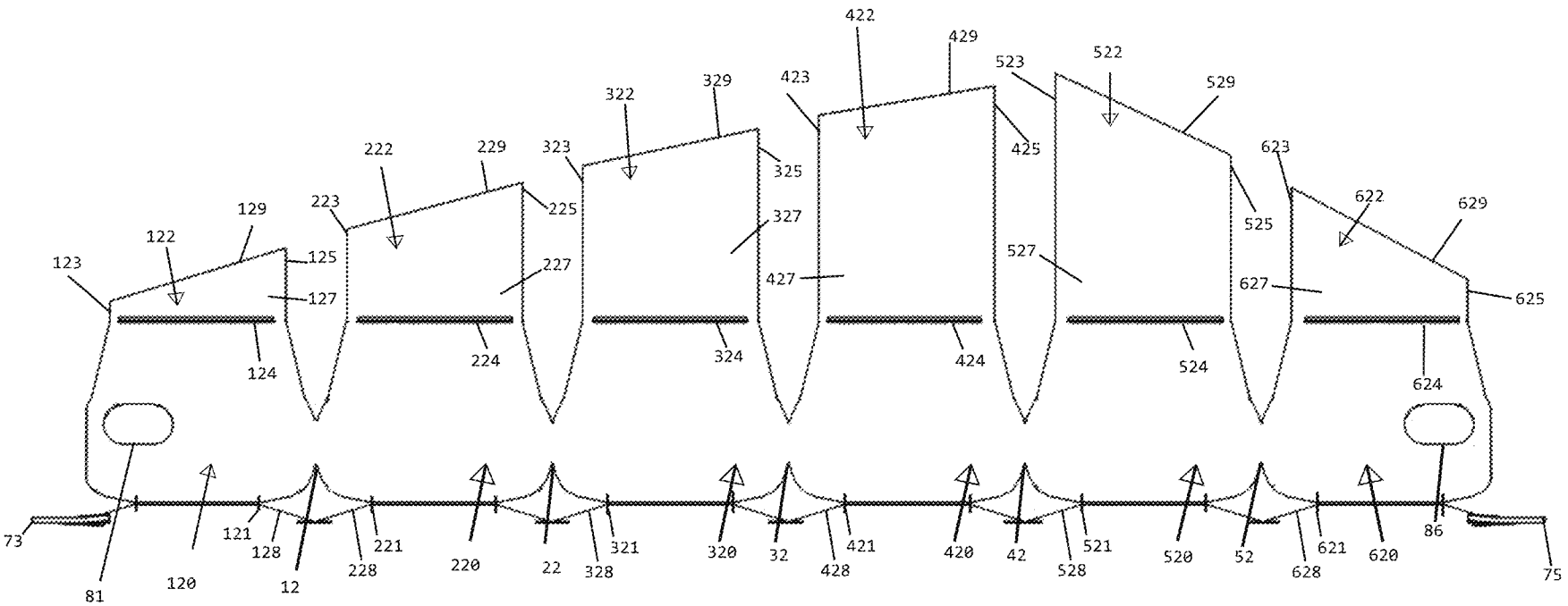
FIG. 4 is a side sectional view of an inboard column of air displacement units an embodiment of the invention.

FIG. 2 is a perspective view side sectional view of an inflatable impact attenuation device in an embodiment of the invention. Shown here is an embodiment of the invention that has six rows as shown in FIG. 1, and 4 columns. Pillars of the device extend upward and are discrete elements providing a cushioning function relatively independent of neighboring pillars. This provides a superior function compared to devices with one continuous impact surface. Pillar 112 and 212 are in an outboard column, on the exterior boundary of the device, and pillars 122, 222, 322, 422, 522, and 622, are in a second column or inboard column interior to the outboard column. Each air displacement unit is shown comprising a pillar, a membrane, and a base cell. In this embodiment, each pillar in the first row, pillars 112, 122, 132, and 142, is constructed equivalently to present a uniform height and top surface angle across the row. For clarity, not all elements are numbered. Second row comprises four air displacement units with pillars 212, 222, 232, and 242, and each has a height and top angle to transition from the first row to the third row. Third row comprises four air displacement units with pillars 312, 322, 332, and 342, and each has a height and top angle to transition from the second row to the fourth row. Fourth row comprises four air displacement units with pillars 412, 422, 432, and 442, and each has a height and top angle to transition from the third row to the fifth row. Fifth row comprises four air displacement units with pillars 512, 522, 532, and 542, and each has a height and top angle to transition from the fourth row to the sixth row. The apex of this embodiment is created by the front wall 513 of pillar 512 where it meets pillar top surface 519. This embodiment present a lower angle of impact in rows one through four and presents a higher angle of impact in rows 5 and 6. This particular embodiment can be used from both sides to accommodate an angle of a falling user in a particular technique or exercise.

Sixth row again comprises four air displacement units with pillars 612, 622, 632, and 642, and each has a height and top angle to transition from the fifth row to a lower boundary at the rear of the device that is easy for a user to clear when falling on the device. In an embodiment of the invention where the first four rows are ascending in height and rows four and five descend towards the rear of the device, base cell can be constructed with a volume of approximately three cubic feet. In a particular embodiment, base cells with a volume of about 3.3 cubic feet can be paired with pillars in the first row having a volume of about 0.44 cubic feet, pillars in the second row of about 0.9 cubic feet, pillars in the third row of about 1.3 cubic feet, pillars in the fourth row of about 1.6 cubic feet, pillars in the fifth row of about 1.3 cubic feet, and pillars in the sixth row comprising about 0.46 cubic feet. Although the pillars in row five have the highest apex, they are also configured with a more sharply sloping top surface, e.g. pillar top surface 519, and therefore contain less air volume than the pillars in row four.

Figure 3:
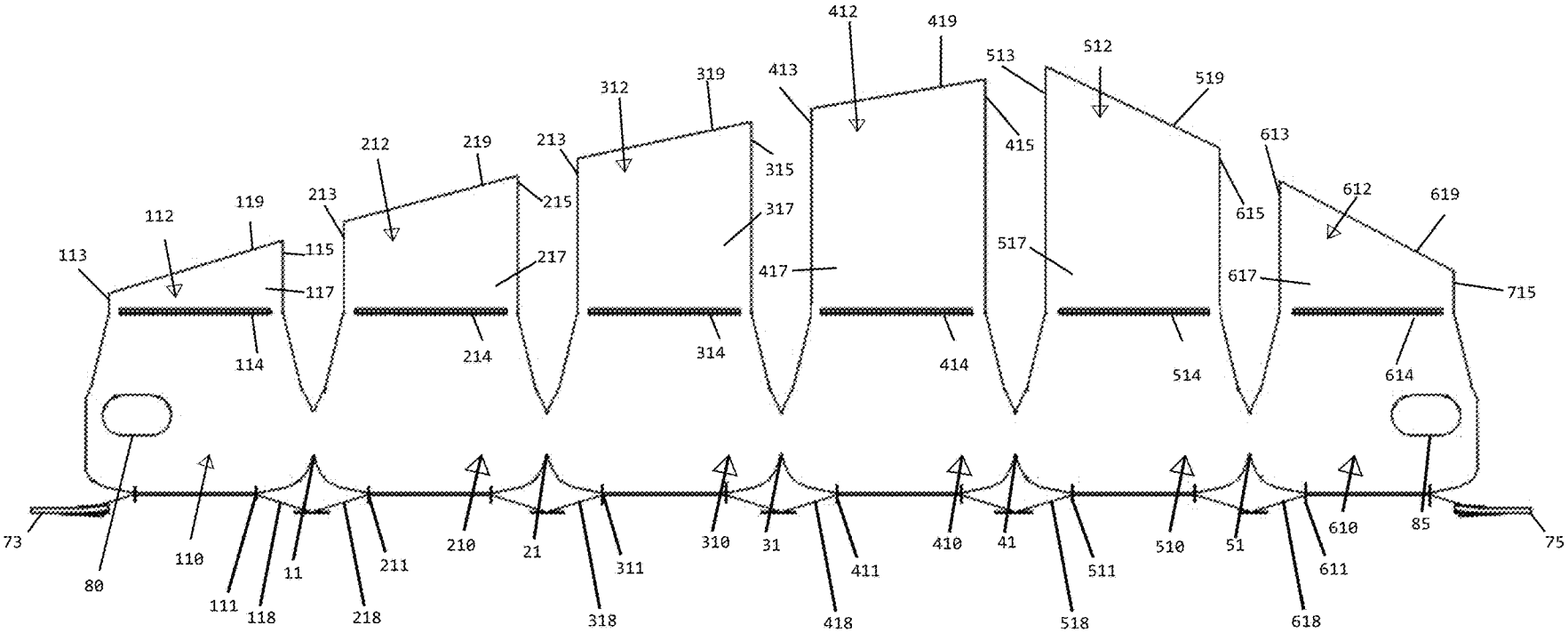
FIG. 3 is a side sectional view of an outboard column of air displacement units an embodiment of the invention.

FIG. 3 is a side sectional view of an outboard column of air displacement units in an embodiment of the invention. Not all elements are numbered for clarity. Base cell 110 is shown with transverse air transport 80. Transverse air transport 80 connects base cell 110 with base cell 120 to allow for fluid communication of air interior to the device. Upon impact, a user will contact one or more pillars and pushing air into the interior of the device. The particular profile of the deceleration of the user is determined by the ability of air to escape the impacted pillar. In a conventional device comprising one continuous matt, the surface will bounce and provide rebound where the air cannot escape upon impact. In another conventional device, a matt is vented to provide more cushion and deformation upon impact and avoiding rebound or bounciness. In order to provide cushion and maintain efficiency of inflated air, the device of the current invention provides directional air transport to cushion a user. Upon impact, a pillar will deform and air will be forced from the pillar into the attached base cell, for example base cell 310. Base cell 310 is connected to base cell 210 via air transport opening 21 and is connected to base cell 410 via air transport opening 31. Base cell 510 is connected to base cell 410 by air transport opening 41 and is connected to base cell 610 by air transport opening 51. In the embodiment shown, each base cell is connected to the other base cells in a particular column through air transport openings. In the first row, transverse air transport 80 connects base cell 110 in the first column and first row to base cell 120 positioned in the second column and first row. In this way, air displaced upon impact into pillar 212 in the first column can travel to the air displacement units of other columns only by first traveling to the base cell in the first row where it can pass into base cell 120 of the second column and thereafter to other pillars in other rows or columns. Base cell 130 can be connected to base cell 120 with a transverse air transport 81 and base cell 140 can be connected to base cell 130 with transverse air transport 82.

FIG. 4 is a side sectional view of an inboard column of air displacement units an embodiment of the invention. This particular embodiment comprises four columns and six rows of air displacement units. FIG. 4 presents a sectional view of what can be considered the second column. Air transport opening 12 is shown connecting base cell 120 with base cell 220. Air transport opening 22 is shown connecting base cell 220 to base cell 320. Air transport opening 32 connects base cell 320 to base cell 420. Air transport opening 42 is shown connecting base cell 420 to base cell 520. Air transport opening 52 is shown connecting base cell 520 to base cell 620. Membrane 124 spans the top of base cell 120 and provides structural support as well as preventing intrusion of a user into base cell 120. Similar to the air transport openings, membrane 124 partially covers the opening between pillar 122 and base cell 120. This allows air to travel between pillar 122 and base cell 120, but is significantly restricted to provide some resistance to air flow. In this way the membrane partially interferes with air flow between a pillar and a base cell. The cross sectional area that is open and not covered by membrane 124 influences the amount of give or cushion provided by pillar 122 upon impact. Membrane 224 is shown at the interface of pillar 222 and base cell 220. Membrane 324 is shown at the interface of pillar 322 and base cell 320. Membrane 424 is shown at the interface of pillar 422 and base cell 420. Membrane 524 is shown at the interface of pillar 522 and base cell 520. Membrane 624 is shown at the interface of pillar 622 and base cell 620.

Pillar 122 further comprises pillar front wall 123 and pillar rear wall 125, pillar top surface 129 and pillar second side wall 127. Pillar 222 further comprises pillar front wall 223 and pillar rear wall 225, pillar top surface 229 and pillar second side wall 227. Pillar 322 further comprises pillar front wall 323 and pillar rear wall 325, pillar top surface 329 and pillar second side wall 327. Pillar 422 further comprises pillar front wall 423 and pillar rear wall 425, pillar top surface 429 and pillar second side wall 427. Pillar 522 further comprises pillar front wall 523 and pillar rear wall 525, pillar top surface 529 and pillar second side wall 527. Pillar 622 further comprises pillar front wall 623 and pillar rear wall 625, pillar top surface 629 and pillar second side wall 627. Each pillar also comprises a first side wall, not shown in the sectional views. Transverse air transport 81 is shown connecting base cell 120 to base cell 130. Transverse air transport 86 is shown connecting base cell 620 to base cell 630.

Figure 5:
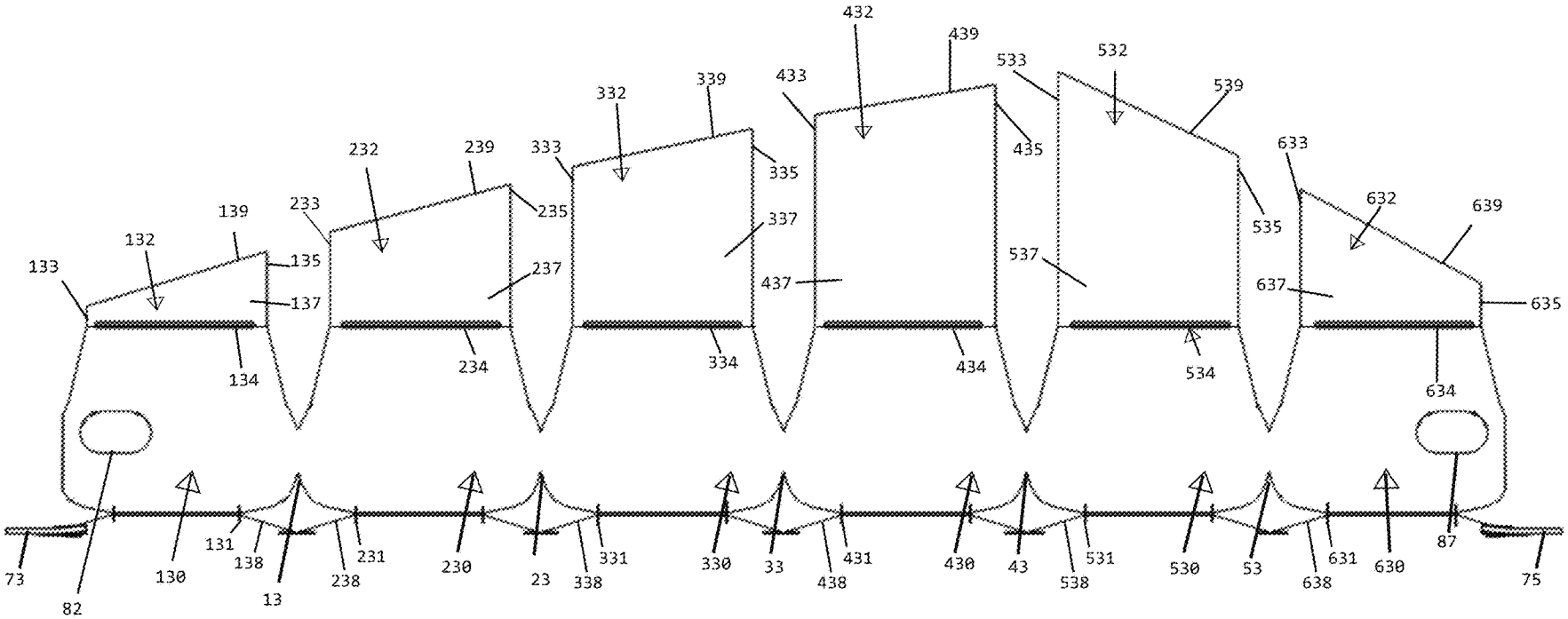
FIG. 5 is a side sectional view of an inboard column of air displacement units in an embodiment of the invention.

FIG. 5 is a side sectional view of an inboard column of air displacement units in an embodiment of the invention. A third column of air displacement units can be constructed in similar manner to the second column with similar dimensions to provide the symmetry and smooth surface shown in FIG. 2. Air transport opening 13 is shown connecting base cell 130 with base cell 230. Air transport opening 23 is shown connecting base cell 230 to base cell 330. Air transport opening 33 connects base cell 330 to base cell 430. Air transport opening 43 is shown connecting base cell 430 to base cell 530. Air transport opening 53 is shown connecting base cell 530 to base cell 630. Membrane 134 spans the top of base cell 130 and provides structural support as well as preventing intrusion of a user into base cell 130. Membrane 134 partially covers the opening between pillar 132 and base cell 130 allowing air to travel between pillar 132 and base cell 130. The cross sectional area that is open and not covered by membrane 134 can be selected to be consistent with other pillars or increased or decreased to provide increased or decreased give of cushion in the pillar upon impact. Membrane 234 is shown at the interface of pillar 232 and base cell 230. Membrane 334 is shown at the interface of pillar 332 and base cell 330. Membrane 434 is shown at the interface of pillar 432 and base cell 430. Membrane 534 is shown at the interface of pillar 532 and base cell 530. Membrane 634 is shown at the interface of pillar 632 and base cell 630.

Pillar 132 further comprises pillar front wall 133 and pillar rear wall 135, pillar top surface 139 and pillar second side wall 137. Pillar 232 further comprises pillar front wall 233 and pillar rear wall 235, pillar top surface 239 and pillar second side wall 237. Pillar 332 further comprises pillar front wall 333 and pillar rear wall 335, pillar top surface 339 and pillar second side wall 337. Pillar 432 further comprises pillar front wall 433 and pillar rear wall 435, pillar top surface 439 and pillar second side wall 437. Pillar 532 further comprises pillar front wall 533 and pillar rear wall 535, pillar top surface 539 and pillar second side wall 537. Pillar 632 further comprises pillar front wall 633 and pillar rear wall 635, pillar top surface 639 and pillar second side wall 637. Each pillar also comprises a first side wall not shown in the sectional view. Transverse air transport 82 is shown connecting base cell 130 to base cell 140. Transverse air transport 86 is shown connecting base cell 630 to base cell 640.

Figure 6:
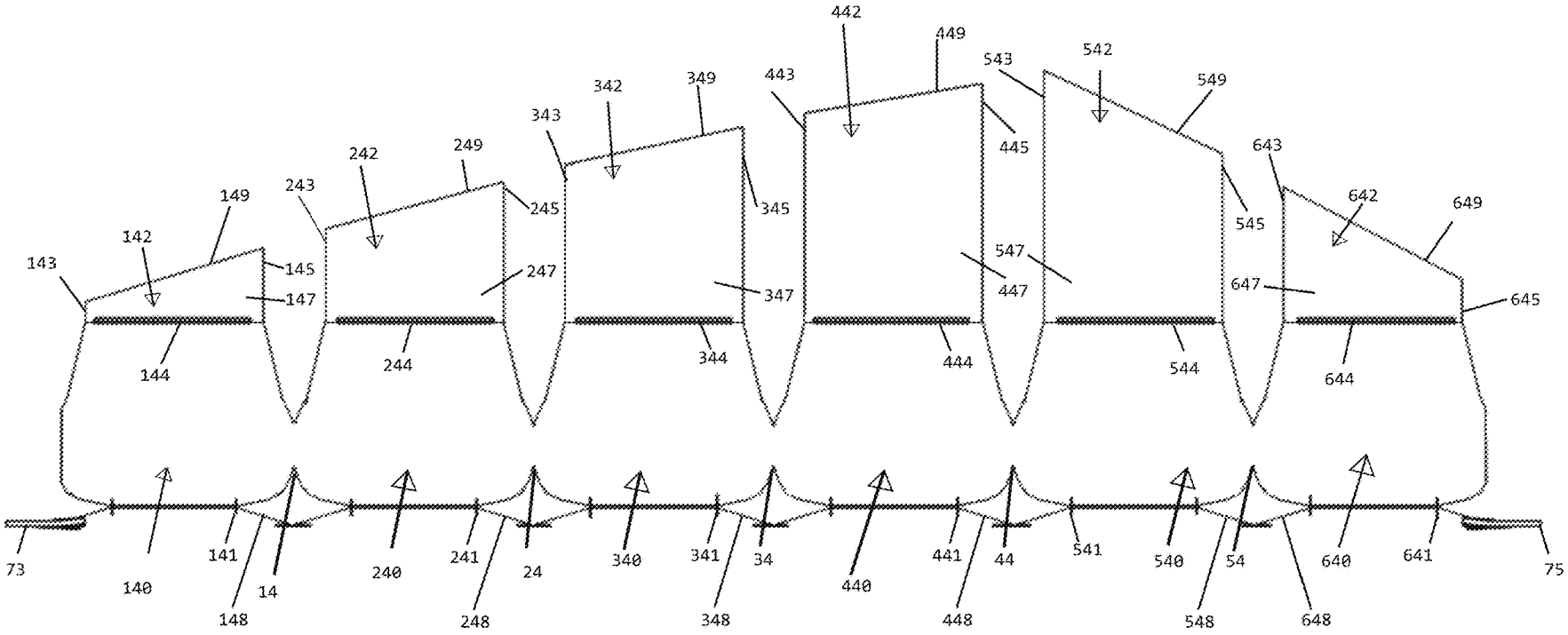
FIG. 6 is a sectional view of an outboard column of air displacement units in an embodiment of the invention.

FIG. 6 presents a sectional view of an outboard column of air displacement units in an embodiment of the invention. A fourth column of air displacement units can be constructed in similar manner to the first column with similar dimension to provide the symmetry and smooth surface shown in FIG. 2. Air transport opening 14 is shown connecting base cell 140 with base cell 240. Air transport opening 24 is shown connecting base cell 240 to base cell 340. Air transport opening 34 connects base cell 340 to base cell 440. Air transport opening 44 is shown connecting base cell 440 to base cell 540. Air transport opening 54 is shown connecting base cell 540 to base cell 640. Membrane 144 spans the top of base cell 140 and provides structural support as well as preventing intrusion of a user into base cell 140. Membrane 144 partially covers the opening between pillar 142 and base cell 140 allowing air to travel between pillar 142 and base cell 140. The cross sectional area that is open and not covered by membrane 144 can be selected to be consistent with other pillars or increased or decreased to provide increased or decreased give of cushion in the pillar upon impact. The membrane for each pillar can be sized up to reduce air flow out of the pillar, or can be reduced in size to increase air flow out of the connected pillar upon impact. Additionally, membrane 144 and the other membranes in the device can be constructed from a mesh fabric, for example polyester or nylon athletic mesh having a void space of 0.045 inch or up to 0.5 inch. At least one particular suitable material is polyester or nylon athletic mesh allowing a stretch ratio of 10% to 80%. Membrane 244 is shown at the interface of pillar 242 and base cell 240. Membrane 344 is shown at the interface of pillar 342 and base cell 340. Membrane 444 is shown at the interface of pillar 442 and base cell 440. Membrane 544 is shown at the interface of pillar 542 and base cell 540. Membrane 644 is shown at the interface of pillar 642 and base cell 640.

Pillar 142 further comprises pillar front wall 143 and pillar rear wall 145, pillar top surface 149 and pillar second side wall 147. Pillar 242 further comprises pillar front wall 243 and pillar rear wall 245, pillar top surface 249 and pillar second side wall 247. Pillar 342 further comprises pillar front wall 343 and pillar rear wall 345, pillar top surface 349 and pillar second side wall 347. Pillar 442 further comprises pillar front wall 443 and pillar rear wall 445, pillar top surface 449 and pillar second side wall 447. Pillar 542 further comprises pillar front wall 543 and pillar rear wall 545, pillar top surface 549 and pillar second side wall 547. Pillar 642 further comprises pillar front wall 643 and pillar rear wall 645, pillar top surface 649 and pillar second side wall 647. Each pillar also comprises a first side wall not shown in the sectional view.

Figure 7:
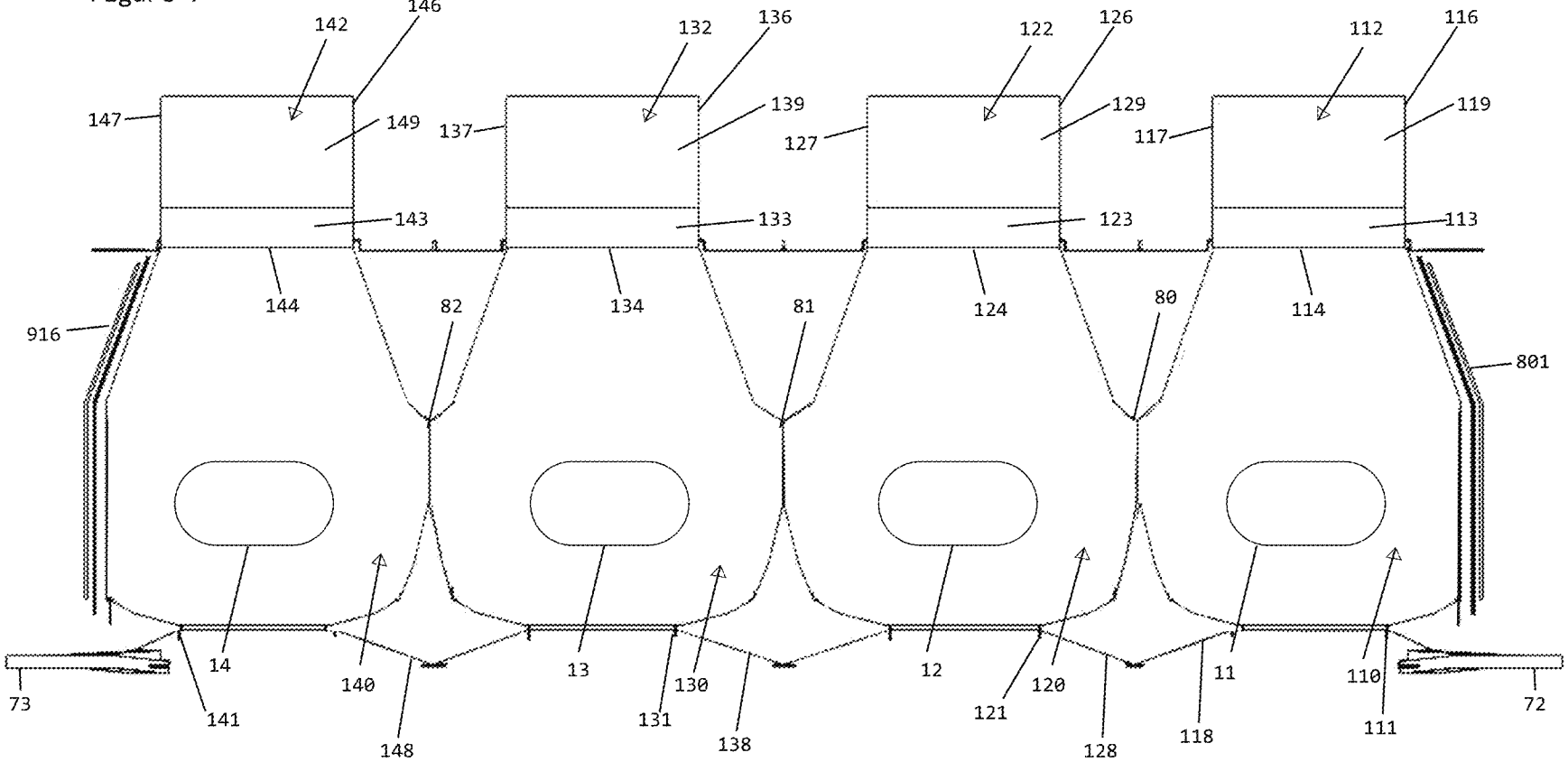
FIG. 7 is a front sectional view of a row of air displacement units in an embodiment of the invention.

FIG. 7 presents a sectional view of a front row of air displacement units in isolation an embodiment of the invention. The other rows of the embodiment are not shown in the figure for clarity. Pillar 112 is shown with a first side wall 116 and a second side wall 117. Each of the pillars of the device can be constructed with a first and second side wall with a consistent manner of construction. Shown here is first side wall 126 of pillar 122 and first side wall 136 of pillar 132 and first side wall 146 of pillar 142. For each pillar, the difference in height between the pillar front wall and the pillar rear wall will determine the angle of the pillar top surface, for example pillar top surface 119. The pillars in the front row are shown with corresponding geometries to provide a consistent angle of the impact surface. Membrane 124 can be sewn to top of base cell 120 as well as to the bottom of first side wall 126 and second side wall 127. The other pillars can be similarly constructed. For added stability, and to limit torsion or sway upon impact, the membranes of the individual air displacement units can be attached or sewn to an adjacent membrane in the same row. For example, membrane 134 can be sewn to membrane 144 and to membrane 124. Membrane 124 can be additionally connected or sewn to membrane 114. Each of the membranes of the air displacement units can be connected to a neighboring membrane to reduce sway or movement of the discrete elements of the device or to provide a maximum limit to such movement.

The device of the invention can comprise tether loops such as tether loop 72, tether loop 73, tether loop 74, and tether loop 75. Tether loops can be used in connection with stakes or alternate affixing devices, such as an elasticated strap, to limit unintended movement of the device during use. Tether loops can be positioned at the corners of the device or alternately along the sides of the device in various embodiments.

Figure 8:
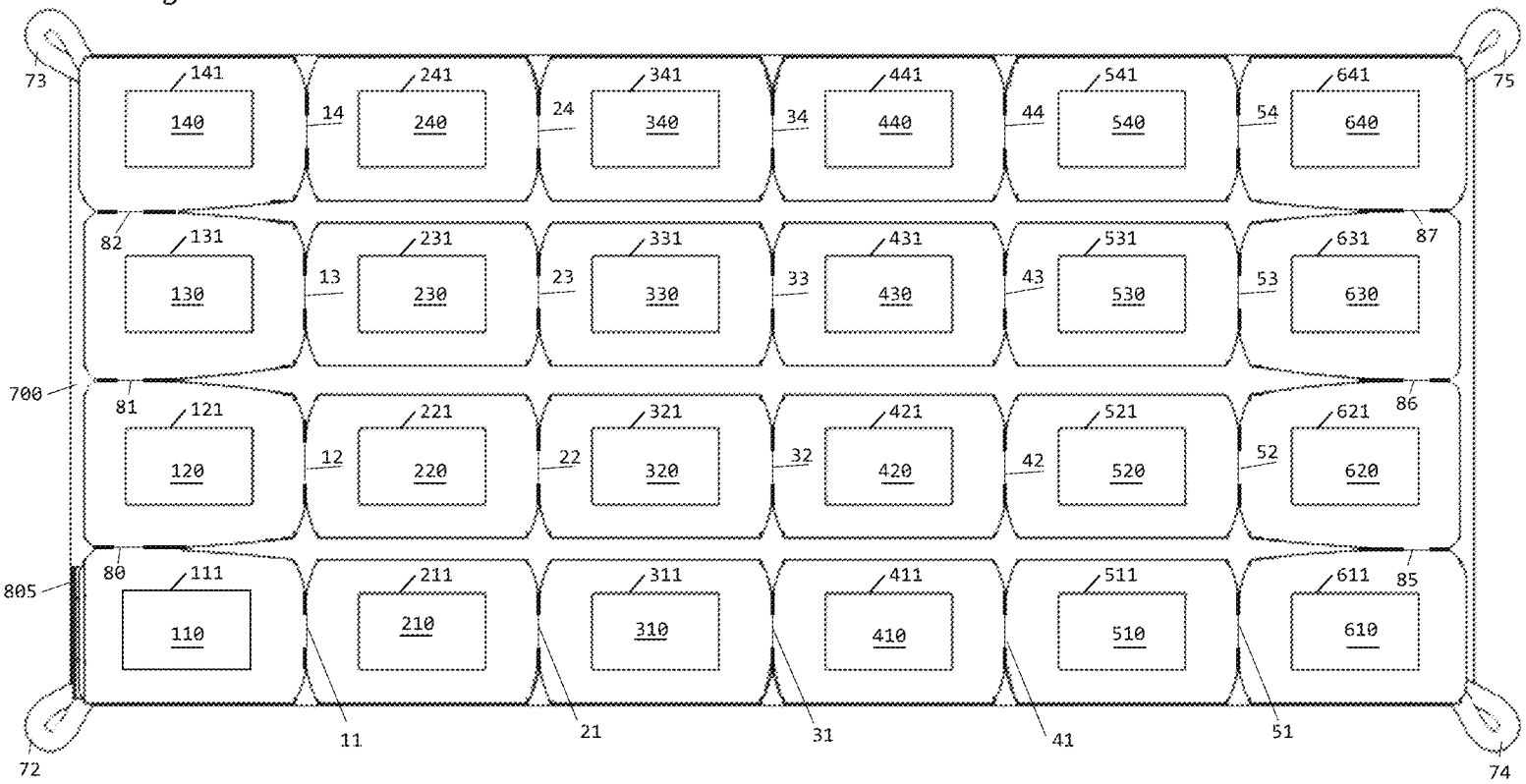
FIG. 8 is a top sectional view of base cells in an embodiment of the invention.

FIG. 8 presents a top sectional view of the base cells in an embodiment of the invention. This section shows the construction of the base cells just below the position of the membranes. This view shows the air transport connections. Each column of base cells is connected to the other base cells in the column via air transport openings. The first row base cells are also connected via transverse air transports 80, 81, and 82. The last row base cells are also connected via transverse air transports 86, 86, and 87. Increasing the size of the air transports in the device increases the deformation ability of the pillars. Decreasing the size of the air transports increases the resistance of the pillars to impact. In an embodiment of the invention, base tarp 700 can be sewn to the bottom of each base cell. This can be done in numerous alternative shapes and methods, but here, a square seam is shown where the base tarp 700 has been sewn to the bottom of the base cell. For example base-tarp connection seam 111 is shown in the bottom of base cell 110. Base cell 210 comprises base tarp connection seam 211. In similar fashion, each base cell of each air displacement can be sewn to base tarp 700, and the connection seams are all presented in FIG. 8 in the first column as 111, 211, 311, 411, 511, 611, and in the second column as 121, 221, 321, 421, 521, 621, and in the third column as 131, 231, 331, 431, 531, 631, and in the fourth column as 141, 241, 341, 441, 541, and 641. The base tarp connection seams are also presented in the sectional views of the air displacement units. In an alternate embodiment, can comprise base tarp tiles. Each tile can be sewn to a base cell individually, and then sewn together for form a single base tarp 700. These base tiles are shown in the various figures and numbered similarly. Base tiles in first column are numbered 118, 218, 318, 418, 518, and 618. Base tiles in the second column are numbered as 128, 228, 328, 428, 528, 628, and in the third column as 138, 238, 338, 438, 538, 638, and in the fourth column as 148, 248, 348, 448, 548, and 648. Base tiles can be square in shape for consistent connection to each other.

Figure 9:
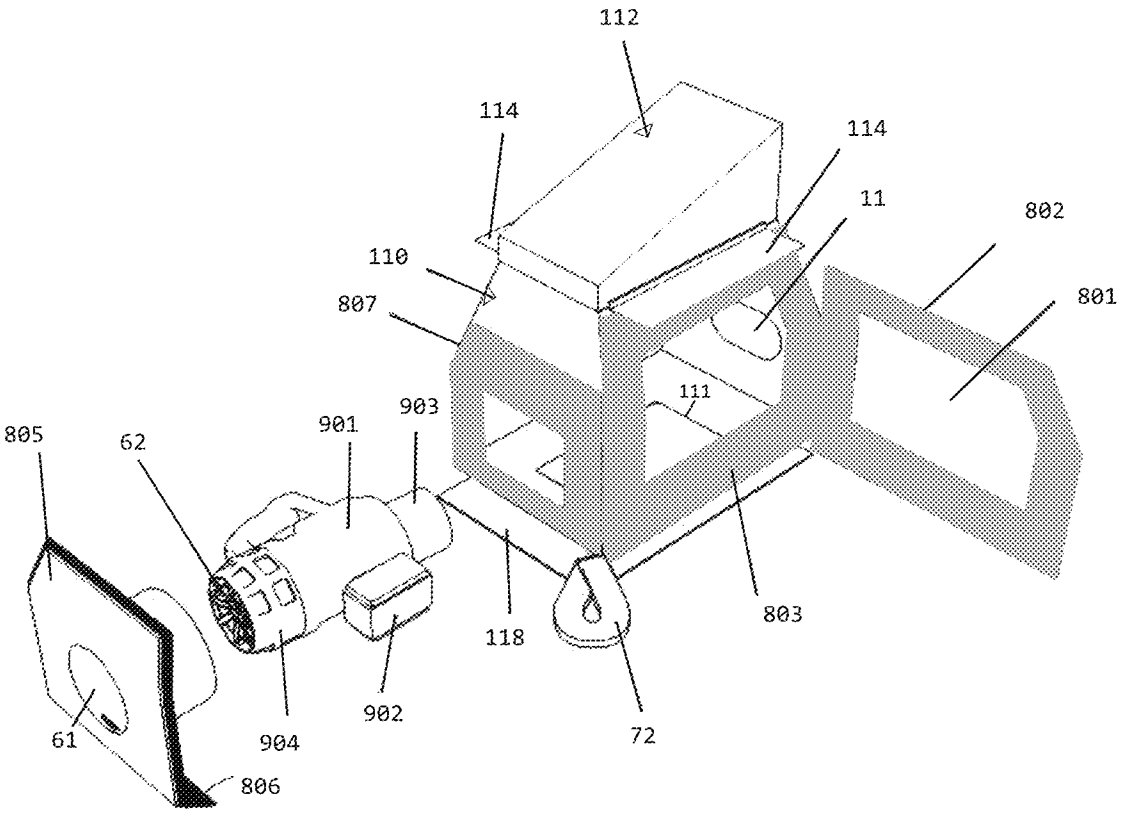
FIG. 9 is a perspective view of an air displacement unit in an embodiment of the invention.

FIG. 9 presents a perspective view of a base cell configured to receive a blower. The air displacement unit is shown with additional features and the features are shown as placed during insertion or removal of the blower into the base cell. In order to increase the portability and flexibility of the device, a portable electric blower such as blower 901 can be positioned within the device. Blower intake cover 805 can be used with intake opening 61 to make a snug connection with blower connection flange 904 while allowing blower inlet 62 to access ambient air. Battery 902 can be rechargeable, for example a 40 volt lithium ion rechargeable battery pack used in tools and leaf blowers. Air is discharged through blower outlet 903. Blower intake cover 805 can be configured with cover attachment material 806 configured to attach to cover attachment receiver material 807, for example hook and loop fastener, and provide a tight connection. Blower access flap 801 can be sewn to base cell 110 to provide a fabric hinge or other connection known in the art and can swing open to provide access to blower 901. In this way, blower 901 can be positioned or turned on or off after a tight connection has been made with blower intake cover 805. Flap attachment material 802 can be attached to the perimeter of blower access flap 801 as shown to connect to flap attachment receiver material 803 and provide a seal against air loss.

Figure 10:
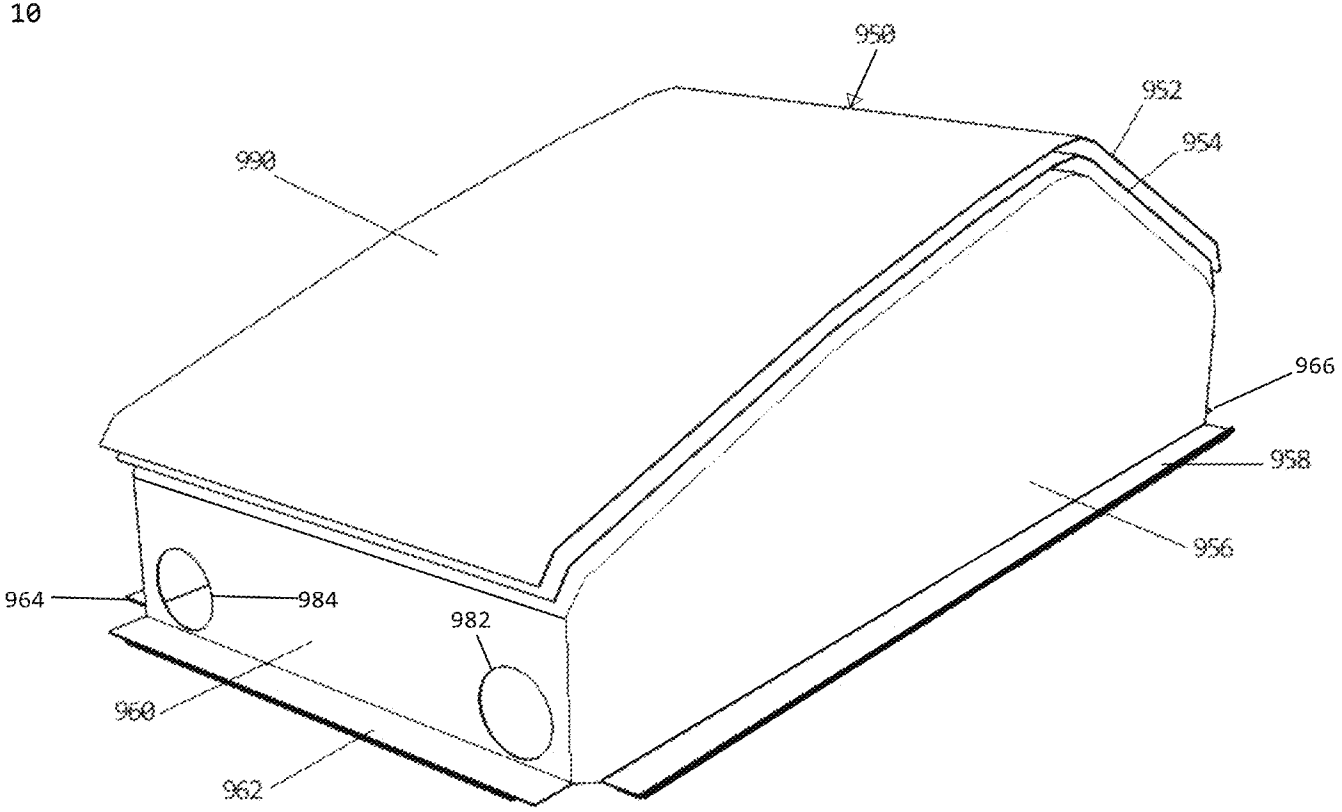
FIG. 10 is a perspective view of a cover in an embodiment of the invention

FIG. 10 presents a perspective view of a cover in an embodiment of the invention. Cover 950 can be used to provide a smooth and flexible surface for a user. Top surface 990 is configured to fit over the discrete pillars of the device. In an embodiment, cover 950 comprises an outer layer 952 and an inner layer 954 sized to cover the pillars of the device outer layer 952 can be made of spandex and inner layer 954 can be made of spandex and the layers combine to provide stretch and slide against each other, the user, and the pillars of the device. Cover 950 is also significantly permeable to air flow so that the device works as a cushion to absorb impact a reduce rebound or stress on impact. Side panel 956 connects to attachment flap 958 that can comprise hook and loop fastener for connection to the underside of the device of the invention, for example base tarp 700. Opposite side attachment flap 964, front attachment flap 962 and rear attachment flap 966 can also comprise connective material to connect to the underside of the device and maintain the position of cover 950 relative to the air displacement units through repeated use. A second side panel similar to side panel 956 can be connected to attachment flap 964 and top surface 990. A front kick panel 960 can be provided with cover blower opening 982 and cover blower opening 984 each configured to be positioned over intake opening 61 and intake opening 63 to allow a blower to operate.

Any description of a component or embodiment herein also includes construction methods and materials including fabrics, connection methods, and sewing techniques which already exist in the prior art and may be necessary to the construction of such component(s) or embodiment(s).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An inflatable impact attenuation device comprising:

a plurality of air displacement units wherein each air displacement unit comprises:

a base cell;

a pillar connected to said base cell, said pillar extending upward from said base cell;

a membrane connected to said base cell and positioned between said base cell and said pillar and at least partially interfering with air flow between said base cell and said pillar; and an air transport opening configured to provide fluid communication with an adjacent base cell.

2. The device of claim 1 wherein:

at least one air displacement unit comprises a second membrane connected to a membrane of an adjacent air displacement unit.

3. The device of claim 2 wherein said pillar of each air displacement unit is spaced apart from adjacent pillars.

4. The device of claim 1 wherein each air displacement unit further comprises a base tile connected to each of said base cells, and each base tile is joined to at least one adjacent base tile to form a base tarp.

5. The device of claim 4 wherein at least one air displacement unit is connected to an adjacent air displacement unit to form a transverse air transport.

6. The device of claim 5 further comprising a cover contacting a first side of said base tarp, extending across each pillar of the device, and contacting a second side of said base tarp.

7. An inflatable impact attenuation device comprising:

a first row of air displacement units comprising a first air displacement unit, a second air displacement unit, and a third air displacement unit;

a second row of air displacement units comprising a fourth air displacement unit, a fifth air displacement unit, and a sixth air displacement unit;

a third row of air displacement units comprising a seventh air displacement unit, an eighth air displacement unit, and a ninth air displacement unit;

said first air displacement unit comprises a first base cell and a first pillar positioned above said first base cell and a first membrane positioned between said first base cell and said first pillar;

said second air displacement unit comprises a second base cell and a second pillar positioned above said second base cell and a second membrane positioned between said second base cell and said second pillar;

said third air displacement unit comprises a third base cell and a third pillar positioned above said third base cell and a third membrane positioned between said third base cell and said third pillar;

said first base cell is connected to said second base cell to form a first transverse air transport;

said second base cell is connect to a said third base cell to form a second transverse air transport.

8. The device of claim 7 wherein said fourth air displacement unit comprises a fourth base cell and a fourth pillar positioned above said fourth base cell and a fourth membrane positioned between said fourth base cell and said fourth pillar; and said fourth base cell is connected to said first base cell to form an air transport opening.

9. The device of claim 7 wherein said first base cell comprises:

a removable blower intake cover comprising a blower intake opening.

10. The device of claim 7 further comprising a base tarp extending from a first side of said device to a second side of said device and attached to the bottom of each base cell of each air displacement unit.

11. The device of claim 10 further comprising a cover removably attached to said base tarp at said first side of said device, extending across each pillar of said device, and removably attached to said base tarp at said second side of said device.

* * * * *